US010858903B2

(12) United States Patent
Carlsen et al.

(10) Patent No.: US 10,858,903 B2
(45) Date of Patent: Dec. 8, 2020

(54) TOOL AND METHOD FOR CLOSED OPERATION IN A SUBSEA WELL

(71) Applicant: FMC Kongsberg Subsea AS, Kongsberg (NO)

(72) Inventors: Tor-Øystein Carlsen, Kongsberg (NO); Trond Løkka, Notodden (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 15/552,255

(22) PCT Filed: Feb. 17, 2016

(86) PCT No.: PCT/NO2016/000007

§ 371 (c)(1),
(2) Date: Aug. 18, 2017

(87) PCT Pub. No.: WO2016/133401

PCT Pub. Date: Aug. 25, 2016

(65) Prior Publication Data

US 2018/0038185 A1 Feb. 8, 2018

(30) Foreign Application Priority Data

Feb. 18, 2015 (NO) ..... 20150229

(51) Int. Cl.
*E21B 33/038* (2006.01)
*E21B 33/076* (2006.01)
(Continued)

(52) U.S. Cl.
CPC ..... *E21B 33/038* (2013.01); *E21B 19/008* (2013.01); *E21B 33/072* (2013.01); *E21B 33/076* (2013.01)

(58) Field of Classification Search
CPC ..... E21B 33/038; E21B 19/008
(Continued)

(56) References Cited

U.S. PATENT DOCUMENTS 3,602,300 A 8/1971 Jaffe
3,638,722 A 2/1972 Talley, Jr.
(Continued)

FOREIGN PATENT DOCUMENTS

EP 1 696 101 A1 8/2006
FR 1.536.233 4/1967
(Continued)

*Primary Examiner* — Matthew R Buck
*Assistant Examiner* — Patrick F Lambe

(57) ABSTRACT

The invention relates to a tool and associated method for making closed operation in subsea wells possible, without the use of cable or coiled tubing up to the rig or ship. The object of this solution is to move such operations to lighter and more cost efficient vessels or ships which are not necessarily required to handle hydrocarbons up to the deck of the vessel. The basis of maintaining two independent well barrier envelopes is met even if the tool and the method for operation does not require cutting functions for isolating the well from the environment. The tool comprises a hoist arrangement, a seal element and connection points. The localization and arrangement of these are essential for the invention. The invention also adapts for use of traditional workover systems as alternative, independent operation, if the new technique should not complete the operation as planned.

6 Claims, 6 Drawing Sheets

Principle sketch of the invention

(51) Int. Cl.
*E21B 33/072* (2006.01)
*E21B 19/00* (2006.01)

(58) Field of Classification Search
USPC ..... 166/360
See application file for complete search history.

(56) References Cited

U.S. PATENT DOCUMENTS

| | | | | |
|---|---|---|---|---|
| 6,719,059 | B2 | 4/2004 | Dezen et al. | |
| 7,063,157 | B2 | 6/2006 | Bartlett | |
| 2008/0264630 | A1 | 10/2008 | Lavrut et al. | |
| 2011/0315392 | A1 | 12/2011 | Edwards | |
| 2012/0037374 | A1 | 2/2012 | Schuurman et al. | |
| 2012/0181038 | A1* | 7/2012 | Edwards ..... | B66D 1/7405 166/339 |

FOREIGN PATENT DOCUMENTS

| | | | | |
|---|---|---|---|---|
| GB | 2 152 979 | A | 8/1985 | |
| GB | 2 284 257 | A | 5/1995 | |
| GB | 2 454 915 | A | 5/2009 | |
| WO | WO 92/14029 | A1 | 8/1992 | |
| WO | WO 2004/003338 | A1 | 1/2004 | |
| WO | WO 2004/065757 | A2 | 8/2004 | |
| WO | WO 2009/016353 | A2 | 2/2009 | |
| WO | WO 2010/050827 | A1 | 5/2010 | |
| WO | WO-2010050827 | A1 * | 5/2010 | ..... E21B 33/038 |
| WO | WO 2012/115891 | A2 | 8/2012 | |
| WO | WO 2013/036145 | A2 | 3/2013 | |

* cited by examiner

Fig. 1: Principle sketch of the invention

The invention placed into system subsea

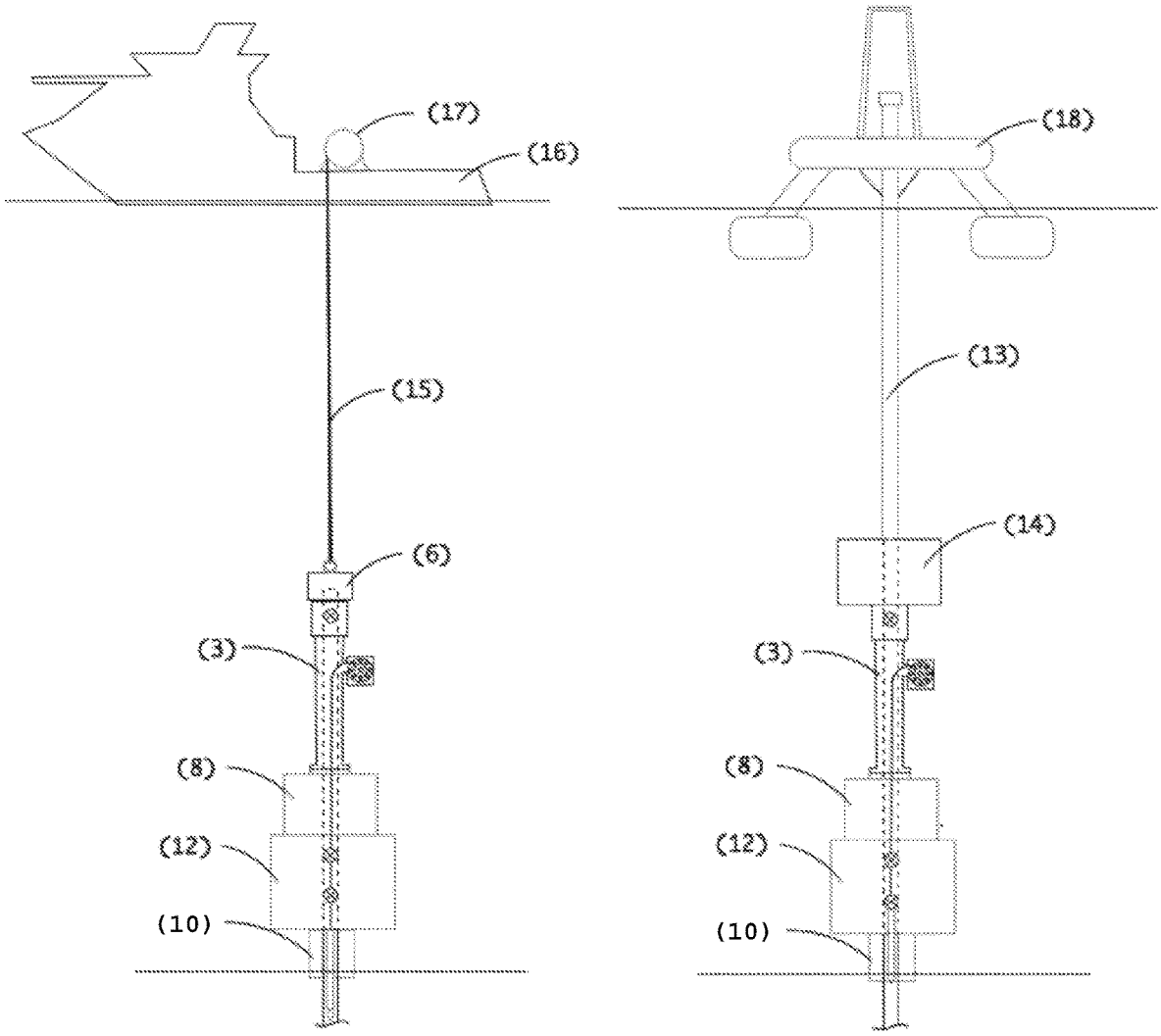
Fig. 3: The invention in operation (left) and alternative operation (right)

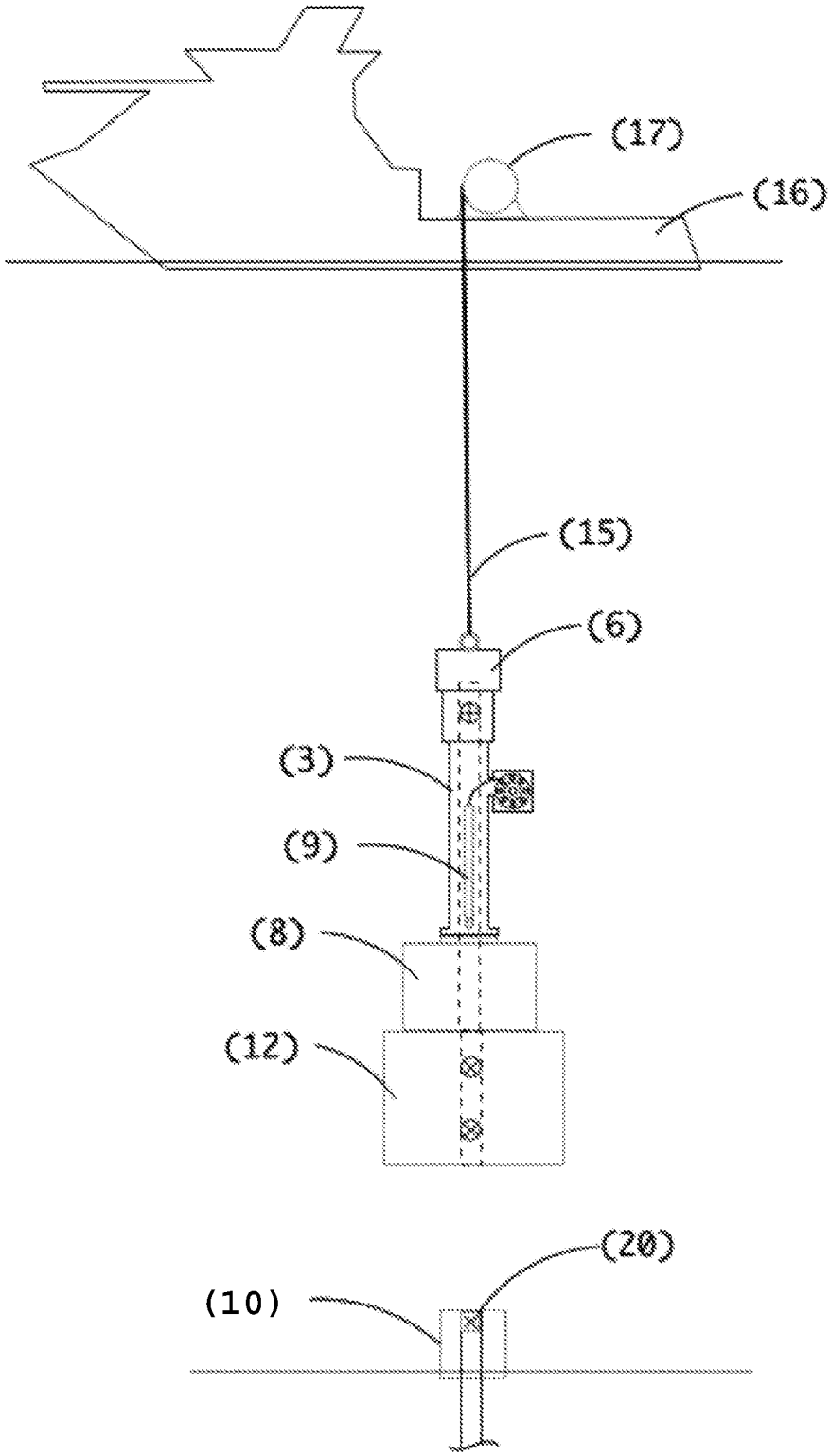
Fig. 4: Installation of well module (Xmas tree) from vessel

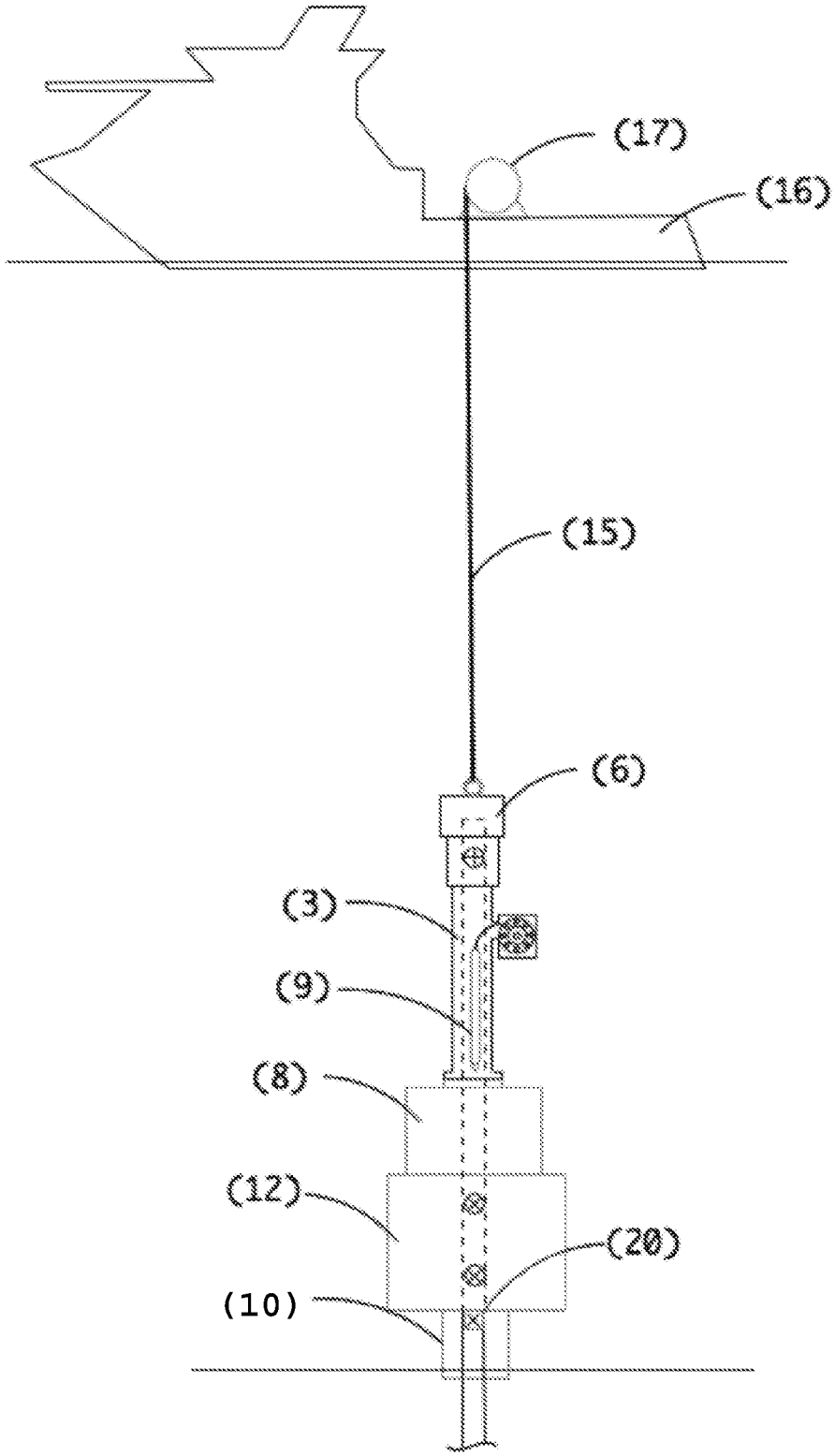
Fig. 5: The tool and well module landed on the wellhead

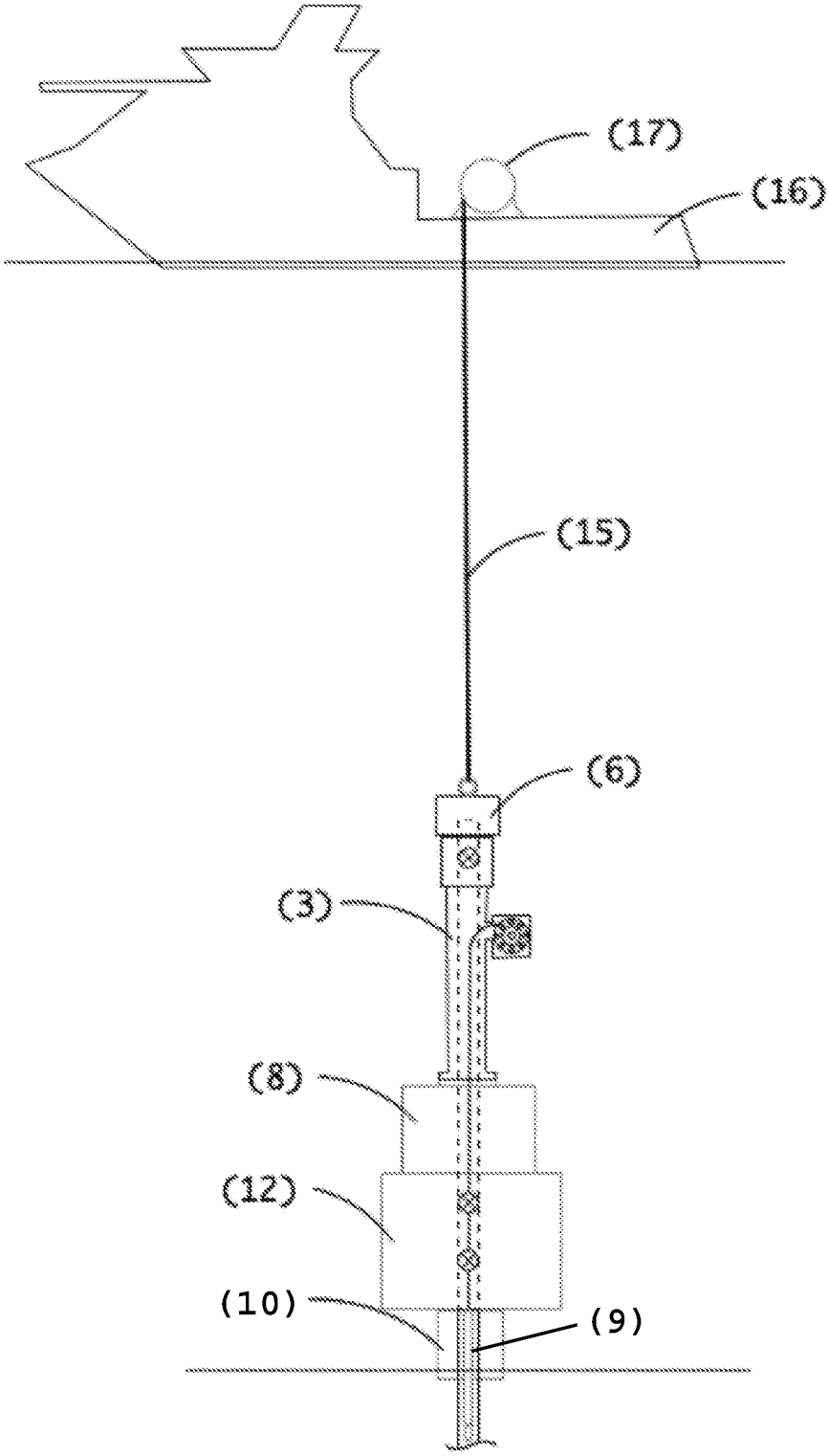
Fig. 6: Well tool in well with closed well operation

TOOL AND METHOD FOR CLOSED OPERATION IN A SUBSEA WELL

The following invention relates to a tool and an associated method of making operations in subsea wells possible, without the use of a cable or coiled tubing connected topside to a rig, ship or platform. In particular, the present invention addresses the requirement to maintain two independent well barrier envelopes—without the use of cut and seal functions. This creates an opportunity to use lighter and more efficient equipment for installing, testing, well maintenance, wellhead stacks and associated operations. This will make it possible to move traditional operations from heavy drilling rigs to lighter vessels, such as boats and ships. However, the invention also makes possible use of traditional work-over systems as an alternative contingency, as alternative, independent operation, should this new technology not complete the operation as intended.

BACKGROUND OF THE INVENTION

The background for the invention is the petroleum industry's demand for cost reducing subsea operations with corresponding or higher security levels, compared to today's practice. It is well known that a substantial capital investment, in both equipment and operational costs, is required in order to develop and operate a subsea oil and gas field that typically consists of several subsea wells and subsea Xmas trees. A large part of such a subsea field development cost relates to the drilling-, completion-, production- and maintenance operations of wells. Traditionally the industry has used larger drilling rigs with its own drill systems to drill and penetrate reservoirs, followed by installation of subsea wellhead and internal casings. After such installation, a subsea Xmas tree is connected to the subsea wellhead to control production after startup. It has been common to install also the Xmas tree from the drilling rig. The start of production from the well normally takes place with so-called workover systems (service system), which is connected to the Xmas tree and which gives a mechanical access from the drilling rig to the subsea well and reservoir. This access allows the possibility of internally running tools on a wire (wireline operation) or a smaller work pipe (coiled tubing—typically 2" pipe) down into the well, by means of a workover system, for pulling plugs and to open towards reservoir for production. Such a workover system may also be used towards maintenance work inside the well for controlling or optimizing production throughout the lifetime of the well. Common to these operations and systems is that they result in high cost to manufacture, operate and maintain.

Consequently, there is a need for solutions that are useful for installation and testing of subsea Xmas trees, as well as maintenance of wells, without the use of a drilling rig. This technology or equipment shall therefore make it possible to move such operations to a lighter vessel or ship, which is not necessarily rated to handle hydrocarbons on the deck of the vessels. It would also be beneficial to let the drilling rig be used for its intended purpose—namely to drill the well and to install casing and production tubing. Further optimization of the drilling rig is achieved, as there is no need to change between the different types of risers in use. The logistics on the drilling rig will also become easier as the subsea Xmas tree is not lifted onboard, as this requires additional space and handling of heavy loads, typically around 30-50 metric tons. The heavy load and size of a work-over system is also substantial, as such a system requires several containers on the deck, as well as large reels with umbilicals.

It will be desirable to introduce new technology that both reduces operational costs, has less weight and size, and which does not expose personnel to equipment carrying well pressure. This will reduce the requirements for lifting and handling system on the vessel, as well as improve health, safety and environment (HSE). One main reason for the large weight for drilling and work-over systems is the requirement to cut and seal the working string that penetrates the barrier envelopes as needed. An example of this would be a loss of well control, so that main safety valves must be activated and shut in or isolate the well from the environment. These safety valves are known as elements of a Blow Out Preventer (BOP) or a Lower Riser Package (LRP). The weight of a BOP may be around 200-500 tons, while an LRP normally weighs around 30-50 tons. The present invention is intended not to penetrate the barrier envelopes, in order to avoid the cutting functionality requirement. This will result in substantially lighter equipment for maintaining well control. Another desired function is to avoid opening of the well, or it being elevated to the vessel. It will, on the other hand, be appropriate to include the possibility of allowing for traditional systems to take over the operation as a back-up solution, should the new technology not complete the operation as planned.

Alternative systems have been proposed, and the nearest prior art is disclosed in the publications U.S. Pat. Nos. 6,719,059 B2, 3,638,722, 7,063,157 B2, US2011/0315392 A1, US2012/0037374 A1, WO2004/003338 A1 and WO2012/115891 A2. None of these publications describes a tool that does not require cutting functions and which simultaneously has the possibility of intervening the well with an independent, alternative operation (back-up).

SUMMARY OF THE INVENTION

The object of the invention is to enable a closed well operation. A closed operation refers to activities in a subsea well without the use of cable or a riser extending to surface, penetrating a well barrier. The invention comprises a hoist arrangement, a sealing element and an upper connection point for alternative operation. The placement, setup and the method of use of these are essential for the invention. When conducting a closed well operation it is imperative to have a secondary method to pull out the well tool, should the primary method fail. By placing the hoist arrangement on the side of the main bore and the seal element above in the main bore, one achieves a safe alternative operation of the well tool. A primary method is to use the shown tool (3) to perform mechanical operation in a well, such as pulling a plug that sits in the well after installation of the Xmas tree the wellhead. If this operation should fail, the tool will still maintain the well isolated from its surroundings, while succeeding secondary operation may be performed by connecting a traditional workover system on top of the illustrated tool (3). Well access is possible by opening, preferably, a valve that sits in the top of the tool, which is used in the primary operation. The plug may thus be pulled with a traditional wire line operation, which is an independent and recognized method.

BRIEF DESCRIPTION OF THE DRAWINGS

FIG. 3 is a depiction of the tool of FIG. 1 shown in both normal operation (left hand side) and in an alternative mode of operation (right hand side);

FIGS. 4 and 5 are depictions of the tool of FIG. 1 shown during installation of a well module on a wellhead; and FIG. 6 is a depiction of the tool of FIG. 1 shown being used in a closed well operation.

The basis of the invention is illustrated in FIG. 1. In FIG. 1 the tool (3) is shown to comprise a lubricator volume (19), which includes a sealing element (2), as well as a hoist arrangement (7). The sealing element may preferably be a subsea operated valve or plug, which may be pulled with a conventional wireline technique. The hoist arrangement (7) is positioned on the side of the tool (3), but exposed to the same pressure as in the lubricator. The hoist arrangement (7) can advantageously be a winch or a pulley. The upper connection point (1) is here illustrated with a lifting device (6) on the top. The lower connection (5) may be a subsea operated connection or a flange, for connection to subsea modules. FIG. 1 also illustrates a tie (4) that is part of the hoist arrangement (7) and which can be made of a wire or fiber.

The invention placed in a larger system as shown in FIG. 2, may perform a closed well operation through a Xmas tree. A typical subsea well will comprise a wellhead (10) and a production tubing (11). On top of the wellhead (10) there may be arranged a well module or a Xmas tree (12). The adapter (8) may include one or more valves for lubrication of well tools, but main valves for lubrication will normally be positioned in the well module (12). Adapter (8) may also include functions to control the well module (12), such as subsea pumps, reservoirs for well control fluid and control valves for controlling valves on the well module (8). These functions may also be used to test barrier seals on the tool (3) and well module (8), as well as other subsea equipment. A well tool (9) may now be lowered into the well, well module or wellhead for intervention operations. FIG. 2 illustrates a work-over system (14) with a riser (13) being able to connect to the connection point (1) for independent alternative operations. This enables a contingency operation to take place, should the ongoing primary operation fail. Valve (2) may be opened to access the main bore in the tool (3), Xmas tree (12) and production tubing (11).

FIG. 3 depicts the invention in operation. The invention may be operated off a boat (16) with a winch (17) and lowered to the well module by using a type of wire (15). For alternative operations a rig (18) can be used with a riser (13) and a traditional workover system (14).

Operational Procedure

Figure 1:
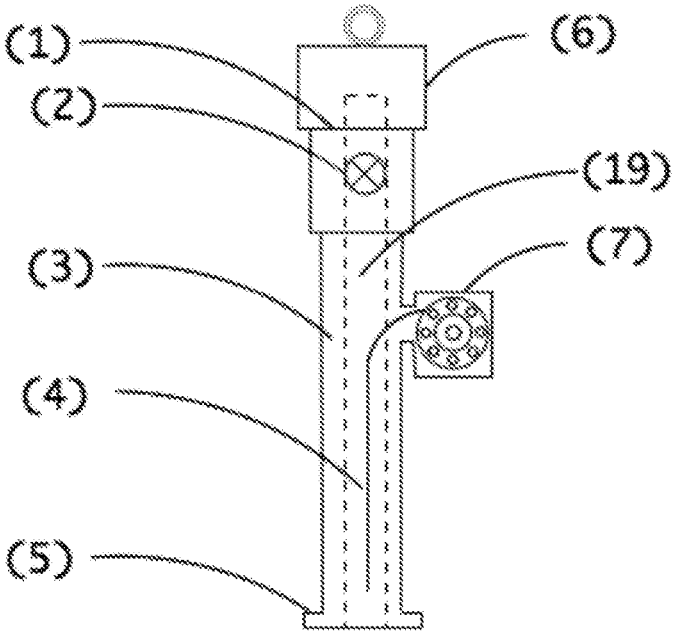
FIG. 1 is a depiction of the tool of the present invention.
Figure 2:
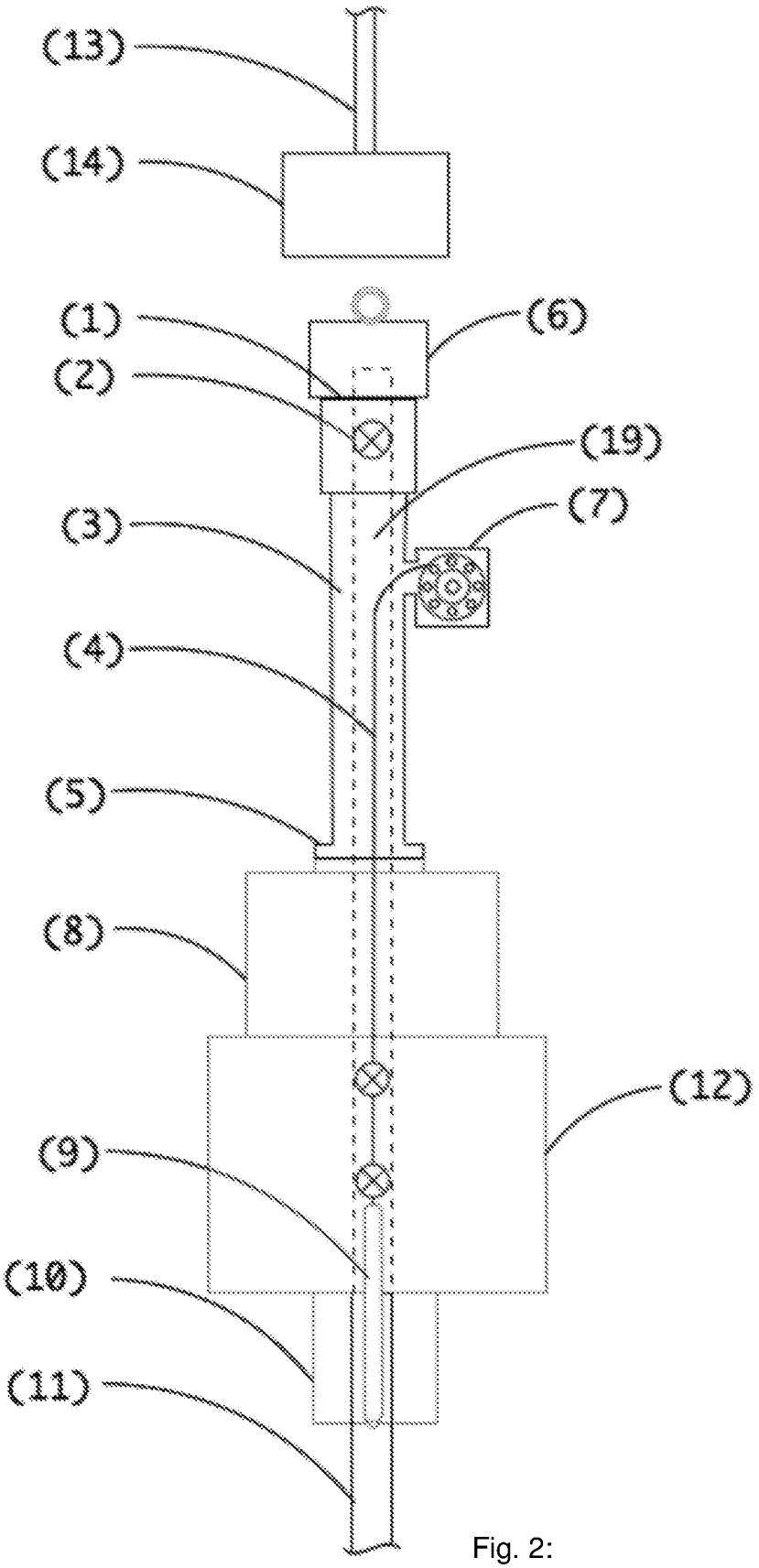
FIG. 2 is a depiction of the tool of FIG. 1 shown incorporated into a subsea system.

The method of closed well operation with the invention is illustrated in FIGS. 4, 5 and 6. FIG. 4 shows the tool (3) with the well module adapter (8) and well module (12) being lowered down from a vessel (16) with the well tool (9) placed in the lubricator (19). Orientation during installation may advantageously be performed with ROV assistance. FIG. 5 shows the tool (3) with the well module (12) and the adapter (8) being landed on the wellhead (10). With the tool connected to the well module (12), the seals in the adapter (8) against the well module (12) are tested. Corresponding tests will be performed between well module (12) and wellhead (10). This procedure requires valves within the well module (12). FIG. 6 illustrates the valves in the well module (12) being open and the well tool pulling possible plugs (20) (FIG. 5) placed in the wellhead (10) or deeper in the production tubing (11). Well access is now such that well operations such as production logging, cleaning or other relevant operations can be performed.

The invention claimed is:

1. A tool for performing closed operations on a subsea well or an associated wellhead module without the use of a cable which extends from a surface vessel and penetrates the well barrier, the tool comprising:

an elongated housing having a top end and a bottom end;

a main bore which extends axially through the housing from the top end to the bottom end, the main bore defining a lubricator volume within the housing;

the housing comprising a lower connection point at the bottom end for connecting the tool to the subsea wellhead module;

the housing comprising an upper connection point at the top end for connecting the tool to at least one of a workover riser system and a lifting device, the lifting device being connectable to an end of a wireline which extends from the surface vessel;

an intermediate hoist arrangement which is directly connected to an exterior side surface of the housing between the top and bottom ends, the hoist arrangement being configured for hoisting and operation of an internal well tool and being connected to but located outside of the main bore; and a sealing element which can be opened and closed, the sealing element being arranged in the main bore below the upper connection point and above the hoist arrangement;

wherein during a primary mode of operation, the lifting device is connected to the upper connection point, the tool is lowered from the surface vessel to the subsea wellhead module on the wireline, and the lower connection point is connected to the subsea wellhead module to thereby enable closed operations to be performed on the subsea well or the associated wellhead module using the hoist arrangement without penetrating the well barrier; and wherein during an alternative mode of operation, the lifting device is removed from the upper connection point and the workover riser system is connected to the upper connection point to thereby enable non-closed operations to be performed on the subsea well or the associate wellhead module through the main bore of the tool.

2. The tool according to claim 1, wherein the sealing element comprises a valve which in an open position provides full access to the main bore below the sealing element.

3. The tool according to claim 1, wherein the hoist arrangement is arranged in a pressurized volume at a same pressure as the lubricator volume.

4. The tool according to claim, 1 wherein the upper connection point comprises part of a first remotely controlled subsea connection and the lower connection point comprises part of a second remotely controlled subsea connection.

5. A method for performing closed operations on a subsea well or an associated wellhead module without the use of a cable which extends from a surface vessel and penetrates the well barrier, the method comprising:

(a) providing a tool which comprises:

an elongated housing having a top end and a bottom end;

a main bore which extends axially through the housing from the top end to the bottom end, the main bore defining a lubricator volume within the housing;

the housing comprising a lower connection point at the bottom end for connecting the tool to the subsea wellhead module;

the housing comprising an upper connection point at the top end for connecting the tool to at least one of a workover riser system and a lifting device, the lifting device being connectable to an end of a wireline which extends from the surface vessel;

an intermediate hoist arrangement which is directly connected to an exterior side surface of the housing between the top and bottom ends, the hoist arrangement being configured for hoisting and operation of an internal well tool and being connected to but located outside of the main bore; and a sealing element which can be opened and closed, the sealing element being arranged in the main bore below the upper connection point and above the hoist arrangement;

(b) connecting the lifting device to the upper connection point and the end of the wireline to the lifting device;

(c) lowering the tool from the surface vessel to the subsea wellhead module on the wireline;

(d) connecting the lower connection point to the subsea wellhead module;

(e) closing the sealing element;

(f) pressurizing the lubricator volume; and (g) activating the hoist arrangement to operate the internal well tool to perform the closed operation;

wherein the internal well tool is operated without the use of a cable which extends from a surface vessel and penetrates the well barrier.

6. The method of claim 5, further comprising:

disconnecting the lifting device from the upper connection point;

connecting a workover riser system to the upper connection point;

opening the sealing element; and performing an intervention on the well through the workover riser system.

* * * * *